United States Patent [19]

Bauer et al.

[11] 3,959,697

[45] May 25, 1976

[54] OIL BURNER SAFETY CONTROL SYSTEM WITH INTEGRAL IGNITION

[75] Inventors: Frederick T. Bauer; Frederick J. Geary, both of Holland, Mich.

[73] Assignee: Robertshaw Controls Company, Richmond, Va.

[22] Filed: Nov. 29, 1974

[21] Appl. No.: 528,157

[52] U.S. Cl. ..... 317/151; 317/96; 431/79

[51] Int. Cl.[2] ..... F23N 5/08; H01H 47/00

[58] Field of Search ..... 317/79, 96, 151; 431/74, 78, 79

[56] References Cited

UNITED STATES PATENTS

| | | | |
|---|---|---|---|
| 3,273,626 | 9/1966 | Brown | 431/79 X |
| 3,338,288 | 8/1967 | Walker | 317/96 UX |
| 3,510,725 | 5/1970 | Tyler | 317/96 |
| 3,556,706 | 1/1971 | Campbell | 317/96 X |
| 3,741,709 | 6/1973 | Clark | 431/79 |

*Primary Examiner*—R. N. Envall, Jr.
*Assistant Examiner*—Harry Moose
*Attorney, Agent, or Firm*—Malcolm R. McKinnon

[57] ABSTRACT

A solid state oil burner safety control system with integral ignition and particularly adapted for use with a motor powered oil burner, the system providing intermittent ignition, timed safety shutdown, motor starting capability and automatic restart in the event of combustion failure. The system is also adapted to prevent burner motor starting if the line voltage is below a predetermined value.

4 Claims, 10 Drawing Figures

OIL BURNER SAFETY CONTROL SYSTEM WITH INTEGRAL IGNITION

BRIEF SUMMARY OF THE INVENTION

This invention relates to oil burner safety controls and, more particularly, to an improved solid state oil burner safety control system with integral ignition capabilities and adapted for use with an oil burner powered by an electric motor utilizing an inductive start winding. Oil burner safety control systems embodying the present invention are eminently suitable for controlling commonly used portable oil construction heaters, water heaters and oil hydronic heaters such as those used in the United States and many European countries.

An object of the present invention is to overcome disadvantages in prior oil burner safety controls of the indicated character and to provide an improved solid state oil burner safety control system incorporating integral ignition means and adapted for use with oil burners powered by an electric motor utilizing an inductive start winding.

Another object of the invention is to provide an improved oil burner safety control system which is adapted to provide intermittent ignition, timed safety shutdown, motor starting capability and automatic restart in the event of combustion failure.

Another object of the invention is to provide an improved solid state oil burner safety control system which is adapted to prevent the oil burner motor from starting if the line voltage falls below a predetermined value.

Another object of the invention is to provide an improved oil burner safety control system which eliminates the necessity of utilizing centrifugal switches and motor relays in conjunction with an oil burner electric motor.

Another object of the invention is to provide an improved solid state oil burner safety control system which utilizes line voltage for the control circuitry thereof.

Still another object of the invention is to provide an improved solid state oil burner safety control system which may be utilized to control oil fueled portable construction heaters, oil fueled water heaters, oil fueled hydronic heaters and other oil fueled burners.

The above as well as other objects and advantages of the present invention will become apparent from the following description, the appended claims and the accompanying drawings.

DETAILED DESCRIPTION

Figure 1:
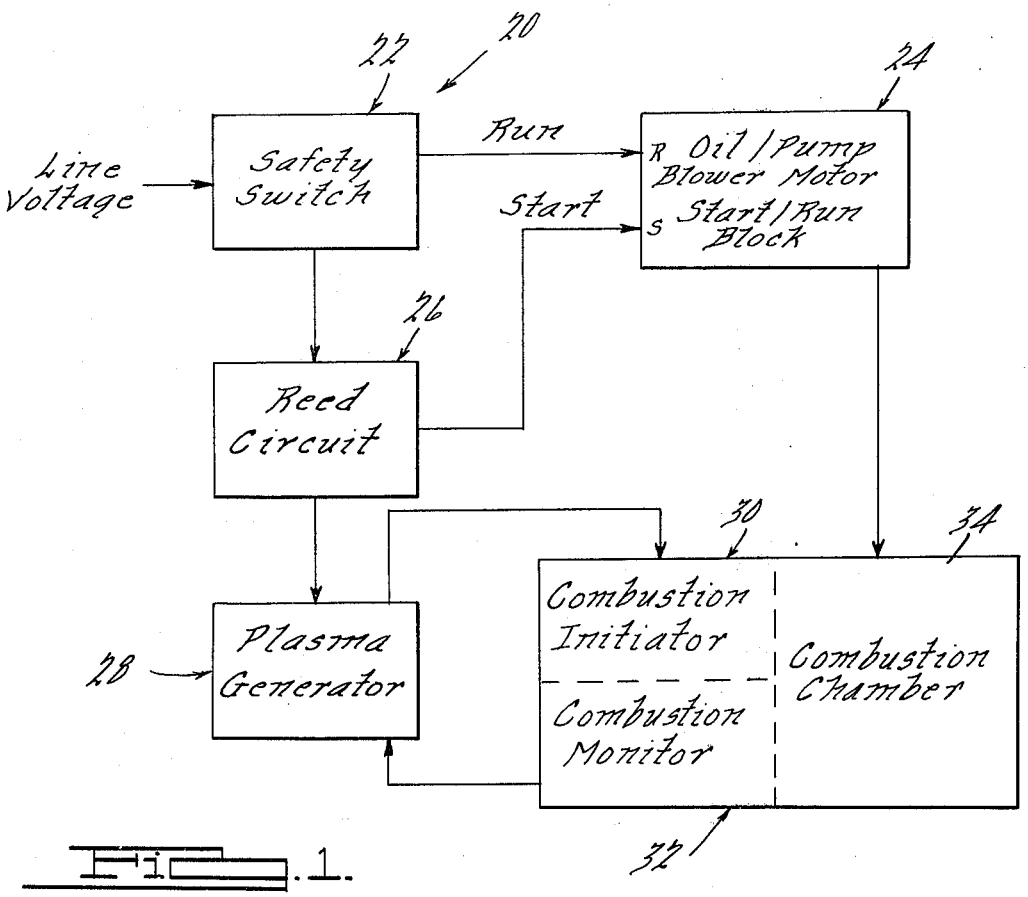
FIG. 1 is a schematic block diagram of an oil burner safety control system embodying the present invention.

Referring to the drawings, and more particularly to FIG. 1 thereof, a schematic block diagram of an oil burner safety control system, generally designated 20, embodying the present invention is illustrated therein. As shown in FIG. 1, the system 20 is comprised of a safety switch circuit, generally designated 22, adapted to be connected to a conventional source of line voltage alternating current, such as conventional nominal 115 volt or nominal 250 volt alternating current. The system 20 also includes an oil pump/blower motor circuit, generally designated 24, a reed switch circuit, generally designated 26, a plasma generator circuit, generally designated 28, a combustion initiator circuit, generally designated 30 and a combustion monitor circuit, generally designated 32, the above described circuitry all being electrically connected by suitable conductors as illustrated in the drawings and as will be described hereinafter in greater detail.

The system 20 is adapted to provide intermittent ignition, timed safety shutdown, motor starting capability and automatic restart in the event of combustion failure. Moreover, the system 20 is adapted to prevent the burner motor from starting if the line voltage falls below a predetermined value, as for example, if the line voltage falls below 90 VAC with a nominal line voltage of 115 volts AC or below 180 volts AC with a nominal line voltage of 250 VAC, plus or minus 20 percent at 50–60 Hz.

In general, the control system illustrated in FIG. 1 operates in the following manner. Line voltage is supplied to the control system 20 through normally closed contacts embodied in the safety switch circuit 22. (The components of all of the aforementioned circuits 22, 24, 26, 28, 30 and 32 will be described hereinafter in greater detail). From the junction at the safety switch circuit 22, there are two branch circuits whose basic functions culminate at the combustion chamber 34 of the burner. One of the branch circuits is the oil pump/-blower motor circuit 24, the ultimate purpose of the circuit 24 being to cause oil to be sprayed into the combustion chamber 34. The second branch circuit is comprised of a safety switch heater embodied in the safety switch circuit 22 for safety shutdown purposes, the reed switch circuit 26 for motor control, and the plasma generator circuit 28 with the associated combustion initiator circuit 30 and the combustion monitor circuit 32 for combustion initiation and monitoring.

Applied line voltage of 90 VAC or greater at a nominal supply of 115 VAC (180 VAC or greater at a nominal supply of 250 VAC) causes the following sequence to occur: The plasma generator circuit 28 initiates a unidirectional high frequency ionic breakdown across electrodes located within the combustion chamber 34 of the burner. Through the activation of the plasma generator circuit 28, current is allowed to flow through the reed switch circuit 26 and the safety switch heater in the safety switch circuit 22. Because of this current, contacts in the reed switch circuit 26 close, and the closing of such contacts causes the burner motor to start whereby the burner motor causes oil to be sprayed into the combustion chamber 34. The oil particles pass through the ionic discharge area of electrodes incorporated in the combustion initiator circuit 30 and are ignited, with the result that the combustion monitor circuit 32, sensing combustion, inhibits the operation of the plasma generator circuit 28, and this inhibition causes current flow through the reed switch circuit 26 and the safety heater of the safety switch circuit 22 to cease. Upon current cessation the reed switch contacts open thereby deactivating the motor start circuit, and the safety lockout timing ends. It will be understood that had combustion not occurred, the plasma generator circuit 28 would have maintained current through the safety switch heater and safety shutdown would have then taken place.

In the event of combustion failure during any part of a normal cycle, the above procedure is automatically reinitiated, the entire procedure then being terminated by removing the line voltage from the control system 20.

Figure 2:
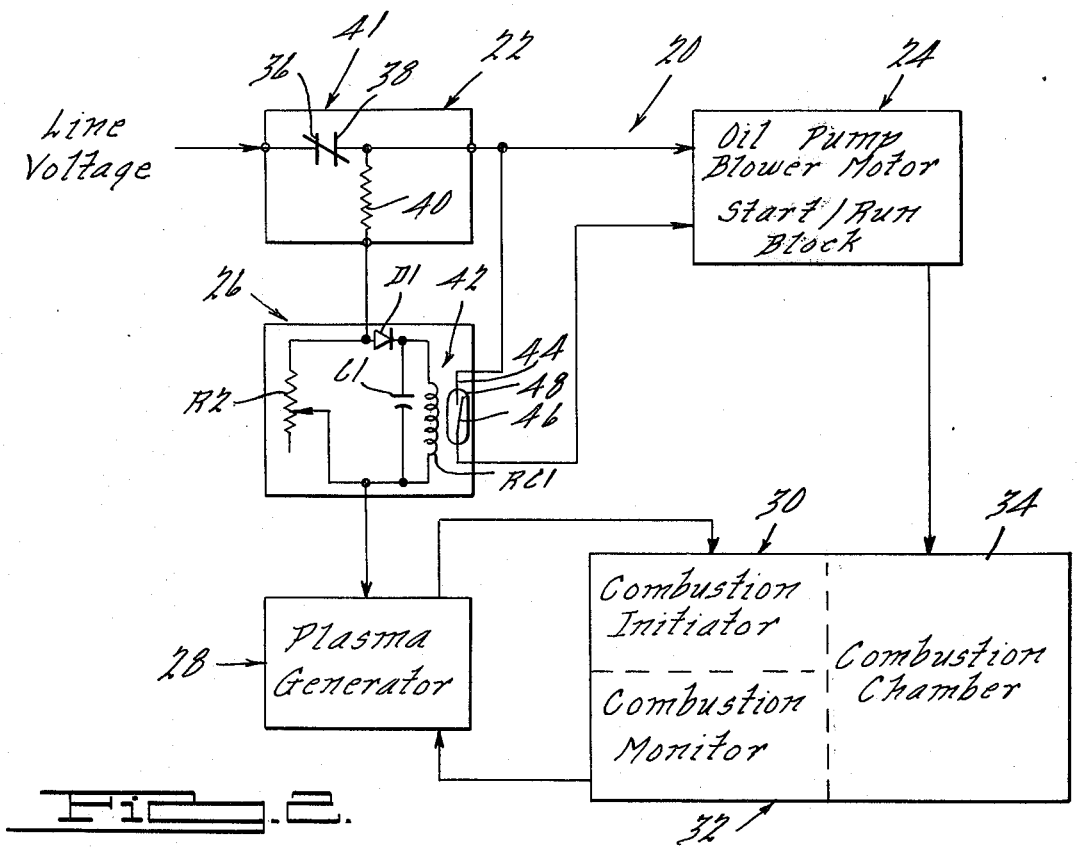
FIG. 2 is a schematic diagram illustrating the circuitry for the safety switch block and the reed circuit block illustrated in FIG. 1.

Referring in greater detail to the various circuits hereinabove mentioned, as shown in FIG. 2, the safety switch circuit 22 is comprised of a pair of normally closed contacts 36 and 38 and a heater coil 40 which may, for example, be embodied in a bimetallic switch, generally designated 41, of the type disclosed in the U.S. application of William J. Russell, Ser. No. 421,525, filed Dec. 14, 1973 and assigned to the assignee of the present invention, in which at least one of the contacts 36 or 38 is carried by a bimetallic member and in which energization of the heater coil 40 for a predetermined period of time is effective to open the contacts 36 and 38 by heating the bimetallic member, as for example for a period of 15 seconds. Opening of the contacts 36 and 38 breaks the line voltage to the control system 20, it being preferred that the contacts 36 and 38 open approximately 15 seconds after attempted ignition of the oil with either 120 VAC or 250 VAC nominal line voltage input. Thus, if combustion does not occur within such predetermined time period, the contacts 36 and 38 open thereby deactivating all circuits for safety shutdown purposes. It will also be understood that a bimetallic switch of the type hereinabove mentioned is trip-free and may be reset by a push button after a cool down period has elapsed.

As shown in FIG. 2, the reed switch circuit 26 is comprised of a potentiometer R2, a diode D1, a capacitor C1, and a reed switch, generally designated 42, having contacts 44 and 46 and an independent, concentrically wound coil RC1, the contacts 44 and 46 being carried by reeds made of magnetic material and being housed within a hermetically sealed glass envelope 48 while the coil RC1 is concentrically wound around the envelope.

Most of the current that flows through the heater coil 40 of the bimetallic switch 41 embodied in the safety switch circuit 22 also flows through the potentiometer R2. This current causes a voltage to be developed across the potentiometer R2 and such voltage is impressed across the series parallel combination of the diode D1, the capacitor C1 and the coil RC1. Voltage impressed across the coil RC1 causes the coil RC1 to develop a magnetic field and since the magnetically actuated reed switch 42 is located within this field, the contacts 44 and 46 will close when the magnetic field reaches a predetermined intensity. Because of the varying nature of the current through the potentiometer R2, the diode D1 and the capacitor C1 are utilized to maintain a steady DC voltage across the coil RC1, the diode D1, acting as a one way valve, allows the capacitor C1 to charge to a voltage equal to that across the potentiometer R2, and then permits the capacitor C1 to discharge through the coil RC1 when the voltage across the potentiometer R2 is reduced. Since the resistance of the diode D1 is extremely low during the capacitor charging cycle and the resistance of the coil RC1 is relatively high during the discharge cycle, the capacitor C1 thus maintains a steady DC voltage across the coil RC1. This steady voltage prevents the reed switch contacts from rapidly opening and closing (chattering) and also allows for a more precise voltage setting across the potentiometer R2 to activate the reed switch 42. The potentiometer R2 can, for example, be set so that the reed switch contacts 44 and 46 will close at voltages over 90 VAC applied (180 VAC for 250 volt nominal supply) but the contacts 44 and 46 will remain open at an applied voltage of less than 90 VAC (180 VAC for 250 volts applied).

Figure 3:
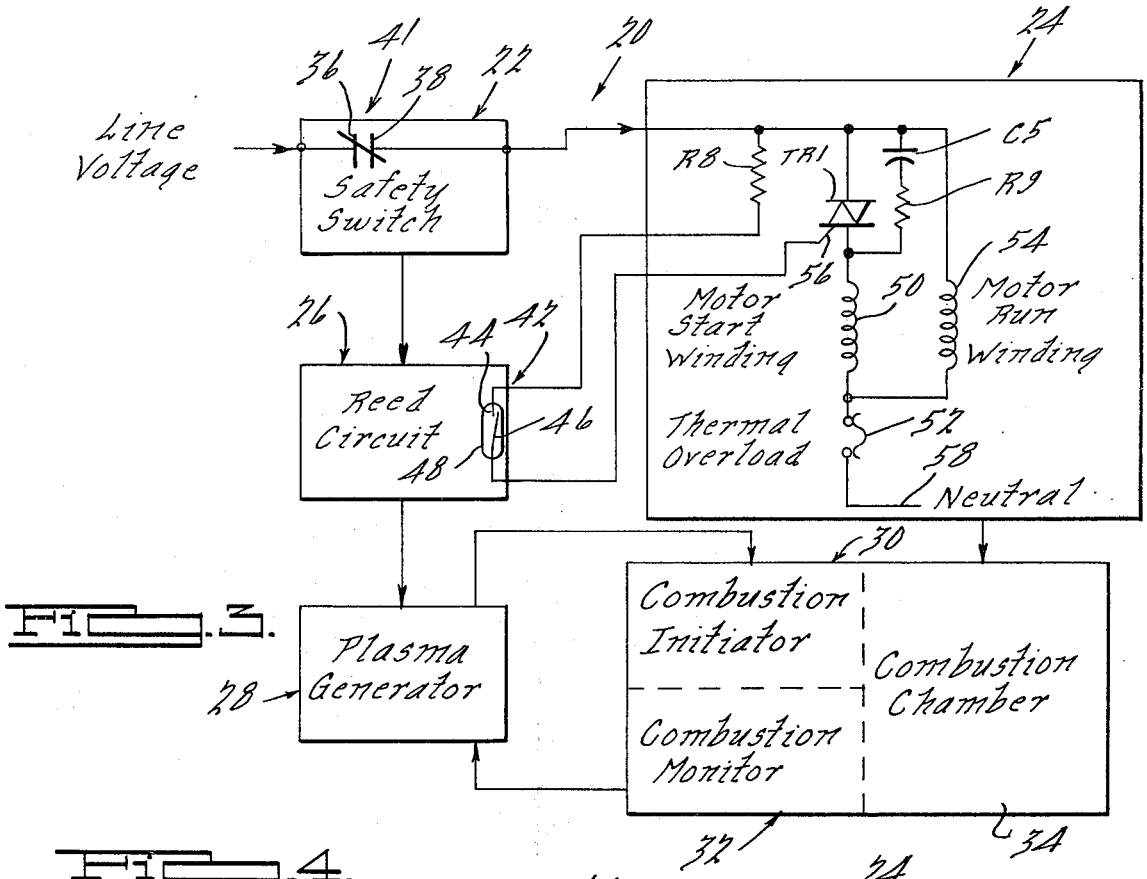
FIG. 3 is a schematic diagram illustrating the circuitry for the oil pump blower motor start/run block illustrated in FIG. 1.

As shown in FIG. 3, the circuit 24 is comprised of the following components: the reed switch 42, a resistor R8, a triac TR1, a capacitor C5, a resistor R9, the motor start winding 50, and a conventional motor integral heat sensing thermal overload protector 52. Connected in parallel to the aforementioned circuit is the run winding 54 of the motor. The voltage applied to such circuits comes from the closed contacts 36 and 38 of the safety switch 41.

If a voltage of 90 VAC (180 for 250 volt supply) or greater is applied to the control system 20, and combustion is not in progress, the reed switch contacts 44 and 46 will close. When the contacts 44 and 46 close, current, limited by the resistor R8, is forced through the gate 56 of the triac TR1. This causes the triac TR1 to go into a conducting state. In a conducting state, the triac TR1 acts as a closed switch. Current then passes through the triac TR1 and into the start winding 50 and thermal overload 52. This causes the motor to start because the run winding 54 is also receiving voltage from the safety switch contacts 36 and 38 to the neutral conductor 58. If for some reason the motor refuses to start, either the safety switch 41 will remove voltage from the entire circuit or the thermal overload 52 in the motor will remove voltage from the motor windings. Either condition protects the motor from burnout. If the motor starts and combustion occurs, the control portion of the circuit will cause the reed switch contacts 44 and 46 to open, thus turning off the triac TR1 and removing the start winding 50 from the circuit. The motor will continue to run because voltage is still impressed across the run winding 54 of the motor. This "start-run" logic of the motor is uniquely able to provide the safety interlock pattern required by every major safety approval agency. The motor's start winding 50 must be energized to start the combustion process, but only the run winding 54 must be energized if the combustion means is to continue.

Figure 4:
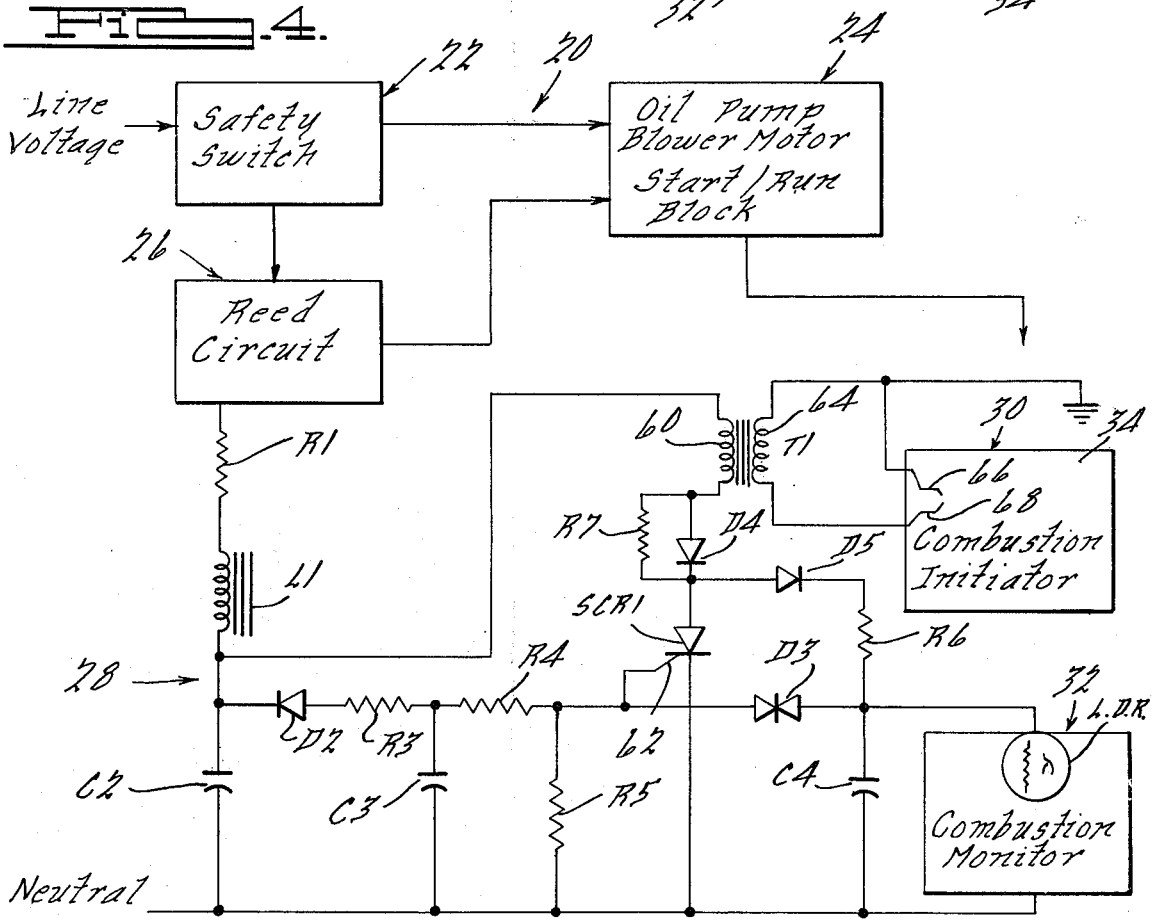
FIG. 4 is a schematic diagram illustrating the circuitry for the combustion initiator, combustion monitor and plasma generator blocks illustrated in FIG. 1.
Figure 5:
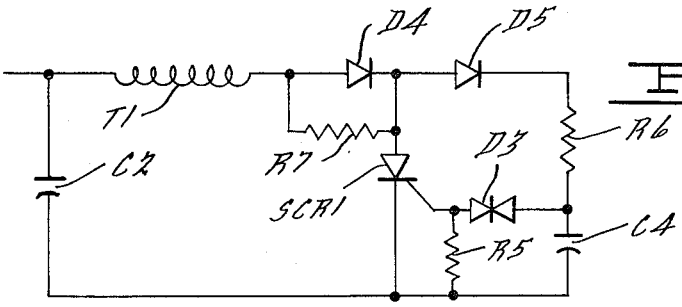
FIG. 5 is a schematic diagram illustrating the circuitry of the plasma generator block illustrated in FIG. 1.

The plasma generator circuit 28, illustrated in FIG. 4, may be divided into three sections illustrated in FIG. 5 for ease of description. These sections comprise (1) a trigger made up of resistors R5 and R6, a diode D5, a capacitor C4 and a trigger diode D3 connected across a silicon controlled rectifier SCR1; (2) an "electronic brake" comprising a diode D2, a capacitor C3 and resistors R3, R4 and R5 connected parallel to the capacitor C2; and (3) the plasma generator proper comprising the silicon controlled rectifier SCR1, a transformer T1, a capacitor C2, a diode D4 and a resistor R7.

Alternating voltage applied to the circuit 28 causes the capacitor C2 to charge to some value of voltage (positive or negative), the rate of charge being determined by the inductance of a choke L1, its DC resistance, and the combined resistance of a resistor R1, the potentiometer R2 and the heater coil 40. During the negative swing of the line voltage, the capacitor C2 charges to the magnitude of the line voltage in a sinusoidal manner. As the line voltage crosses through zero and begins its positive rise, the capacitor C2 charges toward a positive voltage. Since the silicon controlled rectifier SCR1, through the primary winding 60 of the transformer T1, is parallel to the capacitor C2, the silicon controlled rectifier SCR1 cannot conduct during the negative half cycle of the voltage. When the capacitor C2 charges toward a positive voltage this voltage occurs across the silicon controlled rectifier SCR1 anode to cathode.

This same voltage is placed across the resistor R6 and the capacitor C4. Consequently, the capacitor C4 begins to charge to a positive voltage at a rate determined by its capacitance and the resistance of the resistor R6. When the voltage across the capacitor C4 reaches a magnitude of from 28 to 36 volts, it causes the trigger diode D3 to break down, thus discharging the capacitor C4 through the resistor R5 and causing the silicon controlled rectifier SCR1 to turn on through its gate 62. The diode D5 prevents any negative voltage being applied to this circuit.

Figure 6:
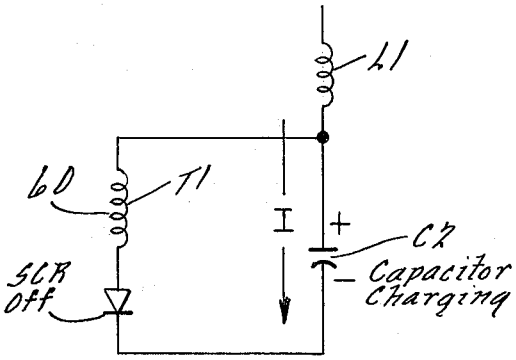
FIGS. 6, 7, 8, 9 and 10 are schematic circuit diagrams illustrating the operation of the circuitry of FIG. 4.
Figure 7:
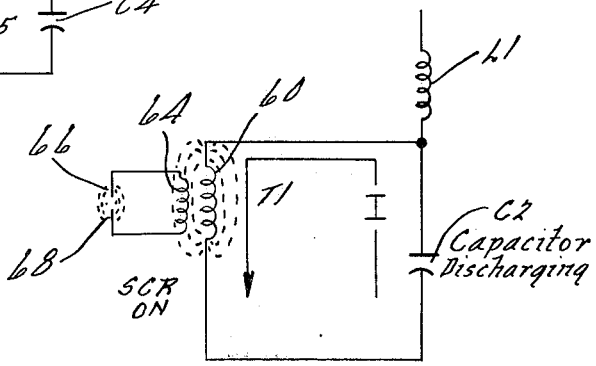
Figure 8:
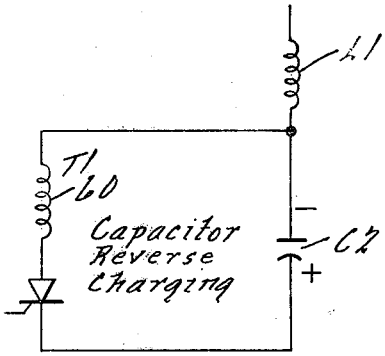

As shown in FIGS. 6, 7 and 8, when the silicon controlled rectifier SCR1 turns on it changes from an open circuit to essentially a short circuit. The high voltage transformer T1 primary winding 60 is then placed directly across the capacitor C2. The low impedance primary winding 60 of the transformer T1 when suddenly placed across the capacitor C2 causes the capacitor C2 to instantaneously discharge. The impedance of the choke L1 momentarily resists the line voltage from maintaining the charge on the capacitor C2. The capacitor C2 then discharges through the primary winding 60 of the transformer T1 and the silicon controlled rectifier SCR1. This discharge causes the transformer T1 to build a magnetic field which cuts its secondary winding 64, generating a high voltage ionization at ignition electrodes 66 and 68. As the discharge energy of the capacitor C2 diminishes the magnetic field of the transformer T1 collapses, forcing current to continue through the silicon controlled rectifier SCR1 in the same direction and causing the capacitor C2 to be charged to the opposite polarity of voltage.

Negative voltage is reflected across the silicon controlled rectifier SCR1 anode to cathode. Negative voltage is also developed from gate to cathode through the aforementioned electric brake section comprising the diode D2, the resistor R3, the filter C3, the resistor R4 and the resistor R5.

Figure 9:
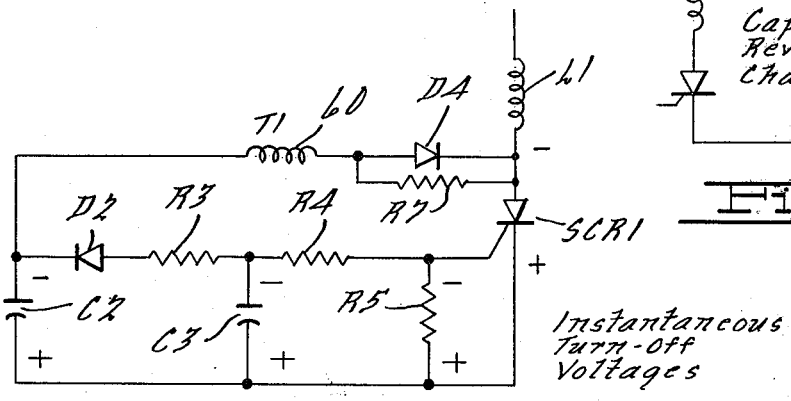

As illustrated in FIG. 9, this negative voltage applied from anode to cathode and maintained from gate to cathode causes the silicon controlled rectifier SCR1 to instantly turn off and again to assume an open circuit condition. When the field of the transformer T1 collapses, the energy for the first microsecond creates an approximate 1200 volt negative spike. Since the silicon controlled rectifier SCR1 is already in conduction and is essentially a slow recovery device (with respect to one microsecond) a very large surge current could be forced through the silicon controlled rectifier SCR1, and such a surge could result in the silicon controlled rectifier dissipating power in the form of heat thereby causing a heat rise which would reduce the capabilities of the silicon controlled rectifier by narrowing its operating parameters. In accordance with the present invention, such a situation is prevented from occurring by the parallel combination of the diode D4 and the resistor R7. The diode D4 is a fast recovery diode which has an approximate 200 nanosecond turn off time. Therefore, when the transformer T1 causes the negative voltage to be developed, the diode D4 "turns off" immediately forcing its parallel resistor R7 to absorb the majority of the negative spike thus relieving the silicon controlled rectifier SCR1 and the capacitor C1 from the unnecessary surge of the first nanosecond of the turn off cycle. This action limits the negative voltage applied to the silicon controlled rectifier SCR1 to about 500 volts. It should be understood that once gated, the silicon controlled rectifier SCR1 is very difficult to turn off reliably, and yet the silicon controlled rectifier SCR1 must be turned off to achieve a multiplicity of ignition pulses during the short time of one-half of the AC voltage waveform. Since only a very small increment of the positive half cycle of applied voltage was consumed during the generation of this pulse, the capacitor C2 again assumes a positive charge, beginning however, from a negative voltage. The above process repeats itself approximately 40 times during each positive half cycle of the applied line voltage. This results in what appears to be a steady ionization arc across the electrodes 66 and 68 of the burner. Since ignition was generated at the same time the oil burner motor was actuated, oil is sprayed through the ionizing arc into the combustion chamber 34. It will also be understood that oil requires much energy to ignite, and that, additionally, the ion path directly between the electrodes 66 and 68 should not be in the oil spray itself or malfunction could result. Consequently, these rapid multiple discharges are preferably "blown" into the oil spray by the blower section of the oil pump/blower motor.

The combustion chamber 34 is monitored by a light dependent resistor (L. D. R.) illustrated in FIG. 10. When sufficient light is generated by the combustion process the resistance of the light dependent resistor L. D. R. drops from a very high value to a very low value.

Figure 10:
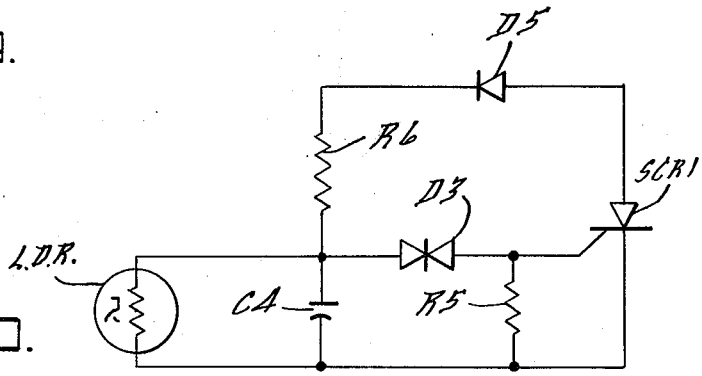

As shown in FIG. 10, the light dependent resistor L. D. R. is connected in parallel to the capacitor C4 and is therefore in series with the resistor R6. When the resistance of the light dependent resistor L. D. R. drops to a low resistance value it causes most of the applied voltage to be dropped across the resistor R6, leaving insufficient voltage across the capacitor C4 to breakdown the trigger diode D3. The silicon controlled rectifier SCR1 therefore will not turn on.

If the combustion process is interrupted when it should not be, the light dependent resistor L. D. R. again assumes a high resistance (no light). This causes less voltage to be dropped by the resistor R6 and more by the capacitor C4. This allows the trigger diode D3 to break down, triggering the silicon controlld rectifier SCR1. Ignition ionization, and safety timing then resume, either causing recombustion or safety shutdown in the manner previously described.

Typical values for the components in the control system described hereinabove are as follows:

| | |
|---|---|
| C1 | 39 MFD at 10 V |
| C2 | .33 MFD at 600 VDC |
| C3 | .02 MFD at 200 VDC |
| C4 | .02 MFD at 200 VDC |
| C5 | .47 MFD at 400 V |

-continued

| | |
|---|---|
| R1 | 10 ohms 22 Watt Wire Wound |
| R2 | 3 ohms Pot 5 Watt Wire Wound |
| R3 | 6.8K ohms 1 Watt |
| R4 | 1K ohms ½ Watt |
| R5 | 560 ohms ½ Watt |
| R6 | 22K ohms ½ Watt |
| R7 | 330 ohms 1 Watt Wire Wound |
| R8 | 82 ohms ½ Watt |
| R9 | 750 ohms ½ Watt |
| Coil 40 | .82 ohms 1 Watt Wire Wound |
| D1 | IN4148 |
| D2 | IN4004 |
| D3 | ST2 |
| D4 | RCA 44933 |
| D5 | IN4004 |
| SCR1 | RCA-C106-D |
| TR1 | GE SC 146 B |
| L1 | Choke Coil |
| T1 | High Voltage Transformer |

It will be understood, however, that these values may be varied depending upon the particular application of the principles of the present invention.

While a preferred embodiment of the invention has been illustrated and described, it will be understood that various changes and modifications may be made without departing from the spirit of the invention.

What is claimed is:

1. In an electrical control system for oil burners, the combination comprising an electric motor including a start winding and a run winding electrically connected in parallel and each adapted to be connected to a main line source of AC current, motor control means connected in series with said start winding and in parallel with said run winding, a control circuit including plasma generating means, combustion initiation means and burner ignition detection means, means interfacing between said control circuit and said motor control means, said ignition detection means being effective to interrupt the flow of electrical current through said interfacing means, said plasma generating means including trigger means and electronic brake means, said trigger means including a silicon controlled rectifier having an anode, a cathode and a gate, a pair of resistors, a diode, a capacitor and a trigger diode, one of said resistors, said diode, said capacitor and said trigger diode being connected across said anode and said cathode of said silicon controlled rectifier, the other of said resistors being connected to said gate.

2. In an electrical control system for oil burners, the combination comprising an electric motor including a start winding and a run winding electrically connected in parallel and each adapted to be connected to a main line source of AC current, motor control means connected in series with said start winding and in parallel with said run winding, a control circuit including plasma generating means, combustion initiation means and burner ignition detection means, means interfacing between said control circit and said motor control means, said ignition detection means being effective to interrupt the flow of electrical curent through said interfacing means, said plasma generating means including trigger means and electronic brake means, said electronic brake means comprising a pair of capacitors, a diode and a plurality of resistors, said diode, said resistors and one of said capacitors being connected in parallel with the other of said capacitors.

3. In an electrical control system for oil burners, the combination comprising an electric motor including a start winding and a run winding electrically connected in parallel and each adapted to be connected to a main line source of AC current, motor control means connected in series with said start winding and in parallel with said run winding, a control circuit including plasma generating means, combustion initiation means and burner ignition detection means, means interfacing between said control circuit and said motor control means, switch means in said control circuit effective to interrupt the flow of current from said main line source of AC current, said ignition detection means being effective to disable said interfacing means and said switch means, said plasma generating means including a silicon controlled rectifier having an anode, a cathode and a gate, a transformer having a primary winding and a secondary winding, a first capacitor, a first diode and a first resistor, said primary winding and said first diode being connected in series with said anode and said cathode, said first resistor being connected in parallel with said first diode, said first capacitor being connected in parallel with said anode and said cathode, said plasma generating means also including trigger means and electronic brake means, said trigger means including said silicon controlled rectifier, second and third resistors, a second diode, a second capacitor and a trigger diode, one of said second and third resistors, said second diode, said second capacitor and said trigger diode being connected across said anode and said cathode of said silicon controlled rectifier, the other of said second and third resistors being connected to said gate.

4. In and electrical control system for oil burners, the combination comprising an electric motor including a start winding and a run winding electrically connected in parallel and each adapted to be connected to a main line source of AC current, motor control means connected in series with said start winding and in parallel with said run winding, a control circuit including plasma generating means, combustion initiation means and burner ignition detection means, means interfacing between said control circuit and said motor control means, switch means in said control circuit effective to interrupt the flow of current from said main line source of AC current, said ignition detection means being effective to disable said interfacing means and said switch means, said plasma generating means including a silicon controlled rectifier having an anode, a cathode and a gate, a transformer having a primary winding and a secondary winding, a first capacitor, a first diode and a first resistor, said primary winding and said first diode being connected in series with said anode and said cathode, said first resistor being connected in parallel with said first diode, said first capacitor being connected in parallel with said anode and said cathode, said plasma generating means including trigger means and electronic brake means, said electronic brake means comprising a second capacitor, a second diode and a plurality of additional resistors, said second diode, said additional resistors and said second capacitor being connected in parallel with said first capacitor.

* * * * *